US006061831A

United States Patent [19]

Rudolph et al.

[11] Patent Number: 6,061,831

[45] Date of Patent: May 16, 2000

[54] COAT-SLEEPING BAG/BACKPACK COMBINATION GARMENT AND CAMPING EQUIPMENT NAMED "COATBAG"

[76] Inventors: Benjamin Rudolph; Amos Lee Rudolph, both of 651 Azalea Rd., Apartment 170, Mobile, Ala. 36609; Jamie Arnes Rudolph, 1553 Colgin St., Mobile, Ala. 36605

[21] Appl. No.: 09/118,694

[22] Filed: Jul. 16, 1998

[51] Int. Cl.[7] ..... A41D 15/04

[52] U.S. Cl. ..... 2/69.5; 2/69; 5/413 R

[58] Field of Search ..... 2/69.5, 69, 79, 2/93, 94, 95, 85, 70; 224/153, 576, 577, 160; 383/4; 5/413 R

[56] References Cited

U.S. PATENT DOCUMENTS

| | | | |
|---|---|---|---|
| 4,103,377 | 8/1978 | Mayer et al. | 2/69.5 X |
| 4,158,892 | 6/1979 | Gonzales | 2/69.5 X |
| 4,507,805 | 4/1985 | Calutoiu | 2/69.5 |
| 4,532,654 | 8/1985 | Sigismonde | 2/69.5 |
| 4,574,397 | 3/1986 | Dennard | 2/69.5 |
| 4,575,876 | 3/1986 | Weaver | 2/69.5 |
| 4,718,122 | 1/1988 | Steverson | 2/70 |
| 4,998,296 | 3/1991 | Stames | 2/69.5 |
| 5,560,043 | 10/1996 | Armstrong | 2/69.5 |
| 5,743,448 | 4/1998 | Tsai | 224/153 |

*Primary Examiner*—Gloria M. Hale

[57] ABSTRACT

The coatbag is a convertible, combination garment/equipment for camping and recreational use during winter activities. The coatbag transforms from a coat and backpack into a sleeping bag. The resulting one-piece unit is highly creature resistant. It is designed such that any and all accessories can be worn or transported within the coatbag.

1 Claim, 8 Drawing Sheets

COAT-SLEEPING BAG/BACKPACK COMBINATION GARMENT AND CAMPING EQUIPMENT NAMED "COATBAG"

A basic reversible coat pattern can be used to construct the coatbag. The coatbag can be made with various combinations of materials including cotton, nylon, polyester, vinyl, blends thereof, and water resistant fabrics. The prototype is made from 65% polyester/35% cotton trigger and is insulated with basic quilt batting. The lining and outer pockets are made from a variety of water resistant denier oxford nylon that contributes to its light weight, durability, and warmth. The heavy duty zippers range from 6 to 84 inches and are strategically placed throughout the coatbag. The 72 to 96 inch nylon drawstring at the bottom of the coat, when drawn, helps to make the sleeping bag more snug and helps to keep the wind out when wearing the coat only. The 6 to 12 inch nylon drawstring to the hood, when drawn, aids in the protection from weather and creatures when sleeping. Attachable gloves help protect creature entrance through the sleeves. The combination of wide, small, and blind stitching in strategic places is utilized on the coatbag. Blind stitching is used on the collar and cuff. Small, reinforced stitching is used on the sleepingbag/backpack section. Heavy duty snaps are used to seal the pockets and other closures throughout the garment. This coatbag comes sizes which range from small to extra large to 4 X according to coat size and lengths from 4 to 12 feet with widths varying from 3 to 6 feet. The liner, which varies in dimension according to the size of the respective coatbag, with packed items intact, is removable prior to transformation into the sleeping bag.

The sleeping bag/backpack section has interior pockets and storage areas. The number and types of specialty pockets and features on the coat and backpacks are similar to other coats and backpacks on the market; specifically U.S. Pat. Nos. 4,651,348—garment with side accessible pocket structures; 352,165—combined vest and backpack; 5,123,117—combination backpack with reversible jacket; 4,389,735—convertible article; and 4,404,687—convertible outerwear and carrying bag. As compared to conventional sleeping bags on the market, the sleeping bag section of the invention is similar in length and width; U.S. Pat. Nos. 1,324,009; 1,648,373; 4,862,533; and 5,640,725. The most similar one-piece sleeping bag was found to be U.S. Pat. No. 4,507,805—ambulatory sleeping bag.

BRIEF SUMMARY OF THE INVENTION

The COATBAG is a coat-sleeping bag combination. The coat can be used by itself or zip on the lower bag section, and it becomes a sleeping bag. When not used as a sleeping bag, the lower section serves as a backpack and is carried as such. It is water resistant and comes with a small tent to cover you while sleeping. Matching gloves and pants are also part of the array of accessories. The coatbag can be used while attending outdoor activities in winter such as camping, hiking, hunting, and sporting events. The coatbag is a warm, durable, light weight, insulated, convertible, versatile, economically space-saving, multipurpose winter garment/or equipment for camping and recreational use.

DETAILED DESCRIPTION OF THE INVENTION

Figure 1:
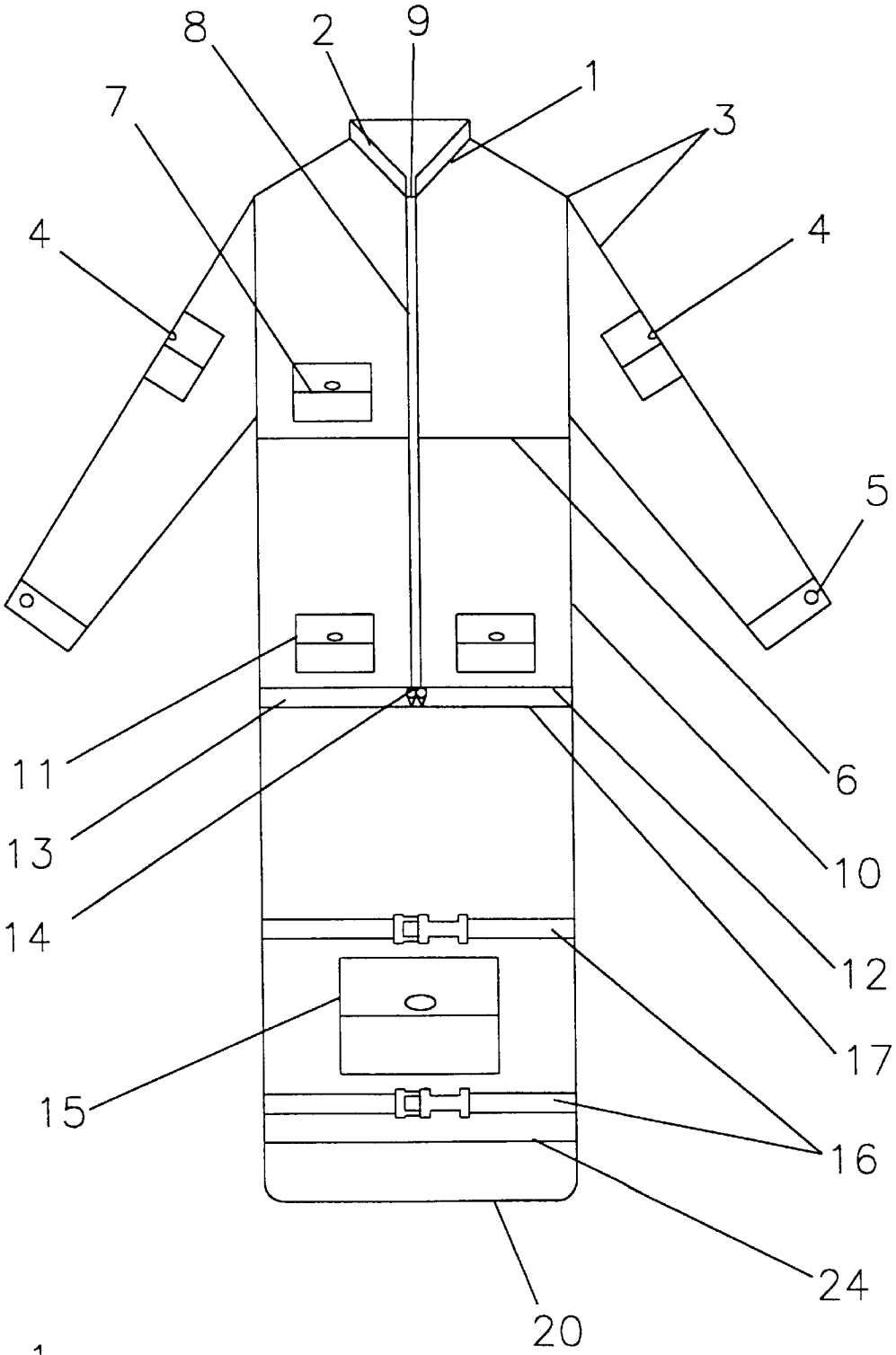
FIG. 1 is a frontal view of the coatbag.
Figure 2:
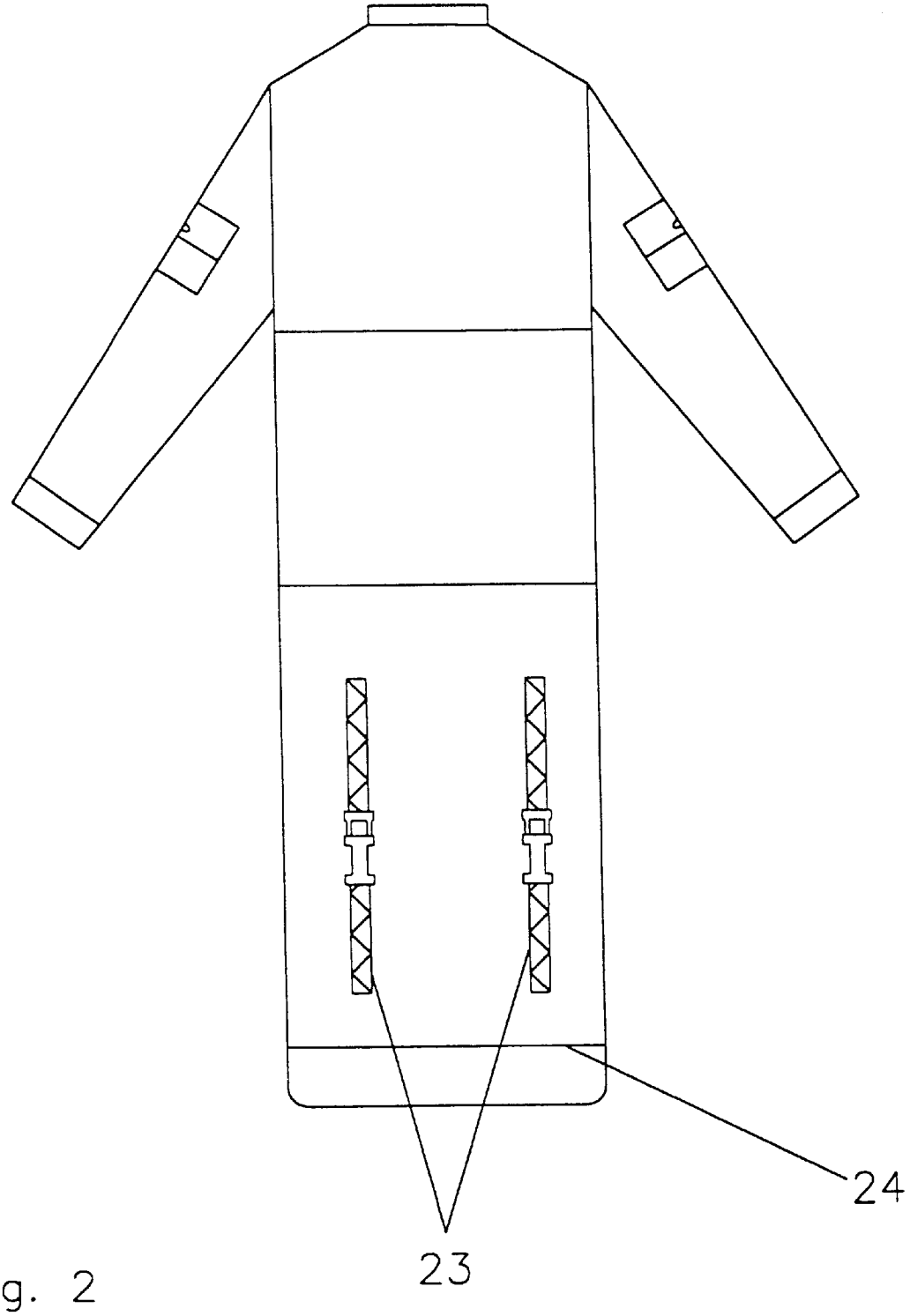
FIG. 2 is a rear view of the coatbag.
Figure 3:
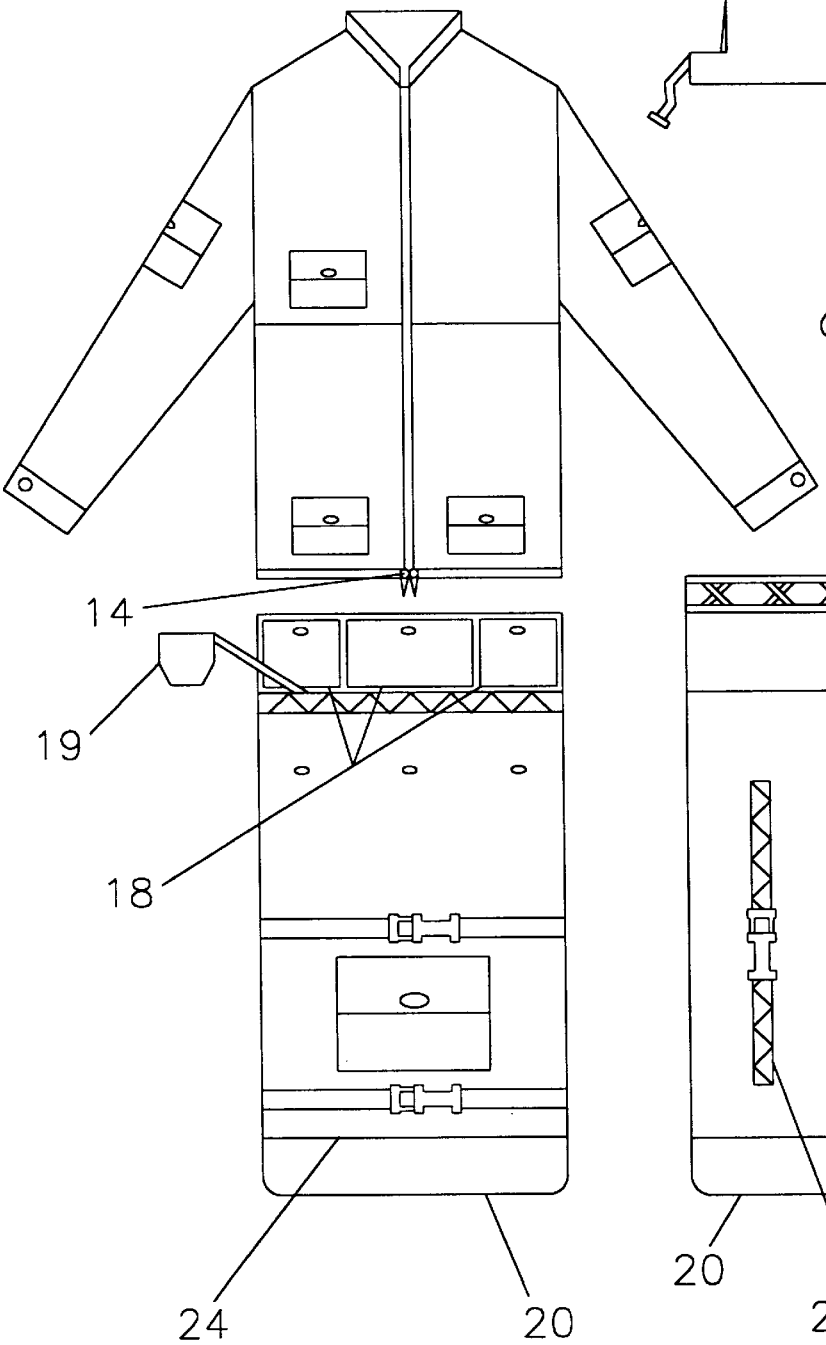
FIG. 3 shows the separate components of the coatbag with some of the optional accessories.
Figure 4:
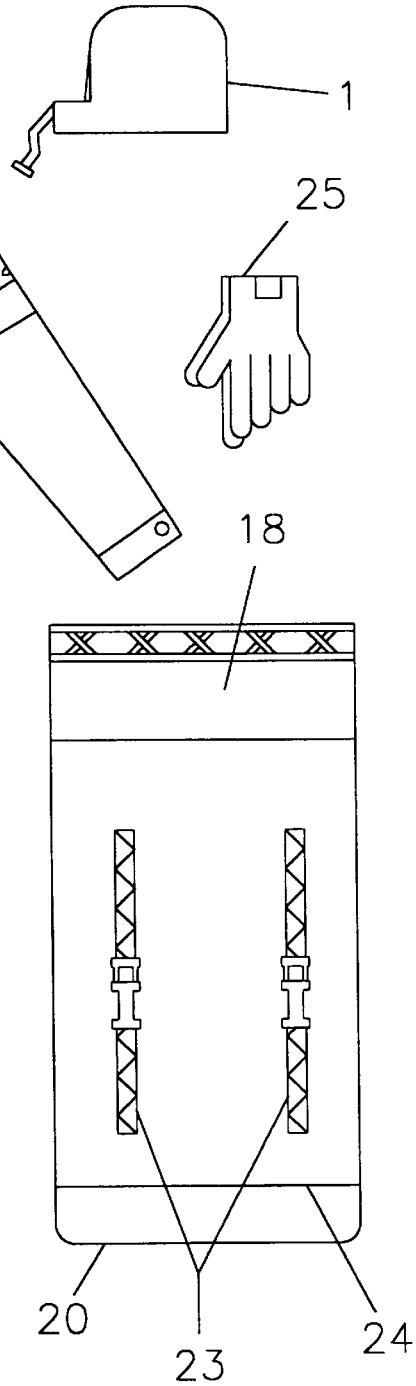
FIG. 4 shows the rear view of the sleeping bag/backpack section.
Figure 5:
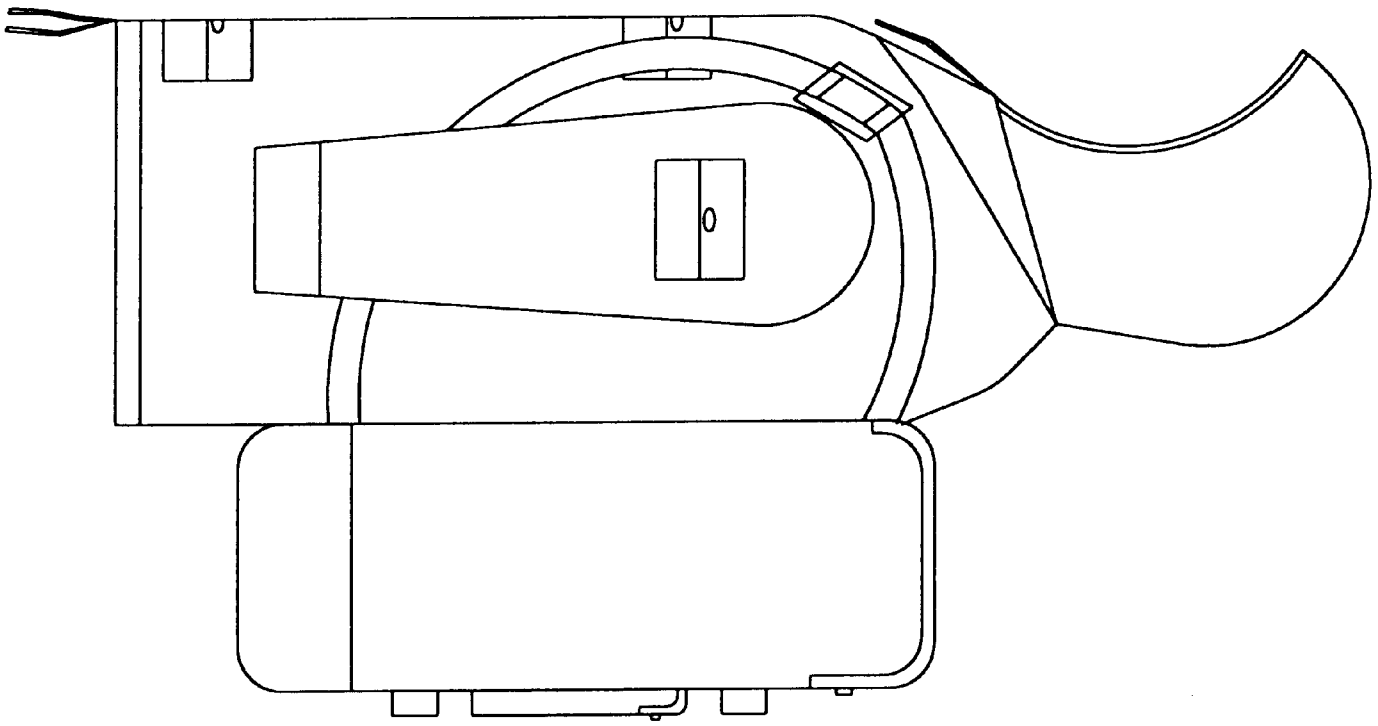
FIG. 5 is a side view of the coat and backpack with hood.
Figure 6:
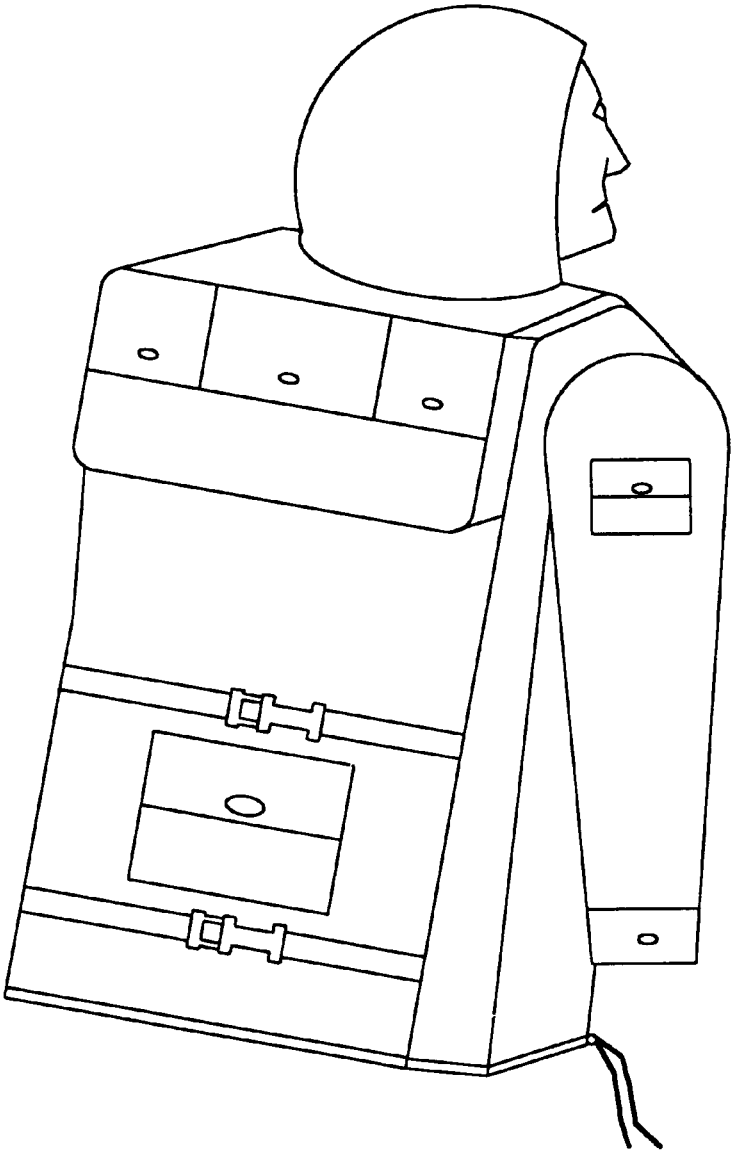
FIG. 6 is a rear view of the backpack and coat. Accessories are shown in the remaining drawings.
Figure 7:
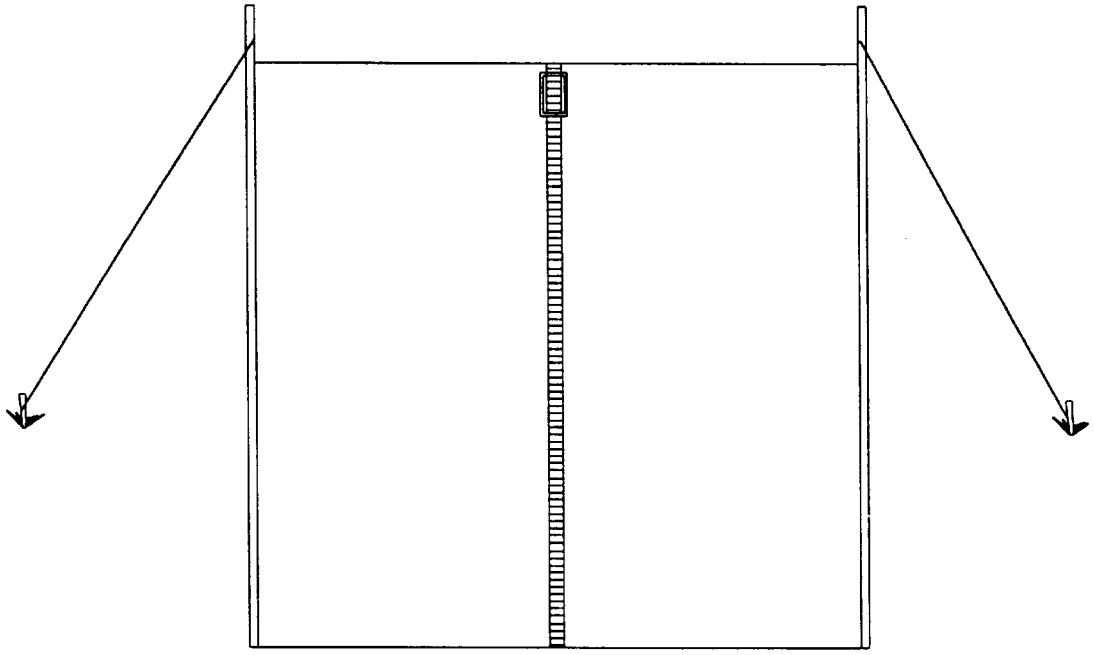
FIG. 7 is a front view of the tent.
Figure 8:
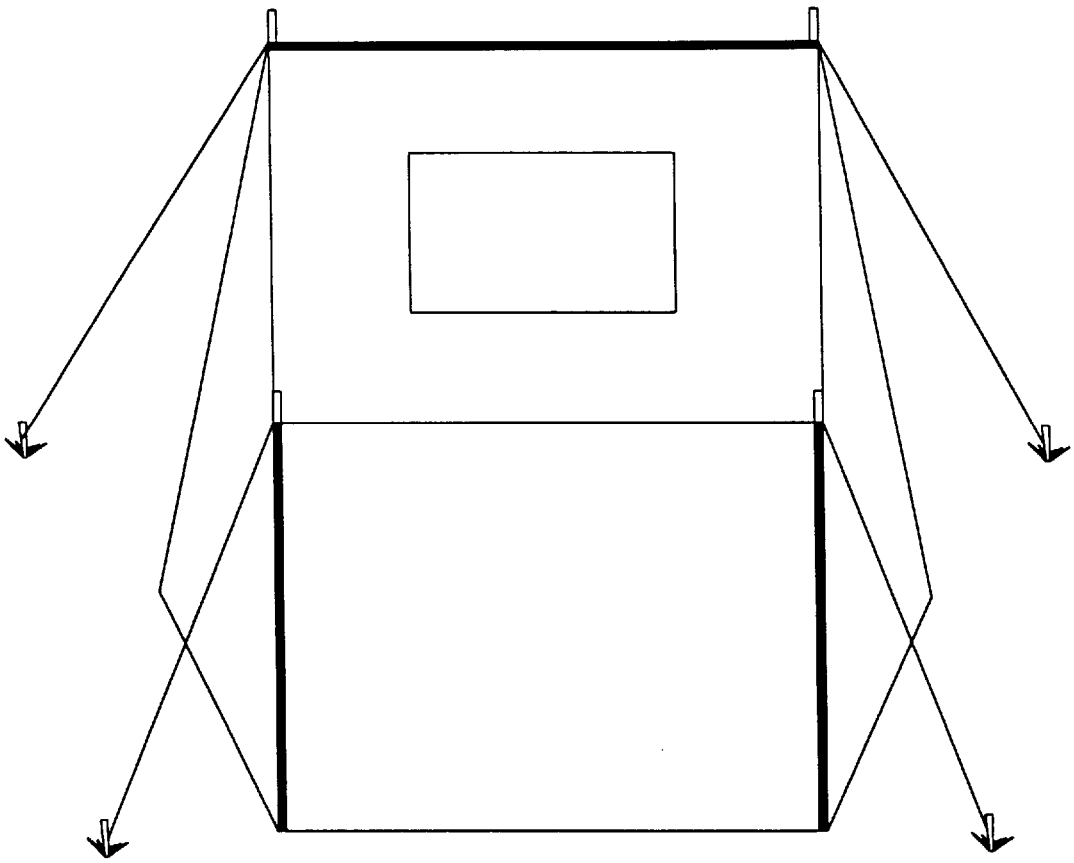
FIG. 8 is the rear view of the tent.
Figure 9:
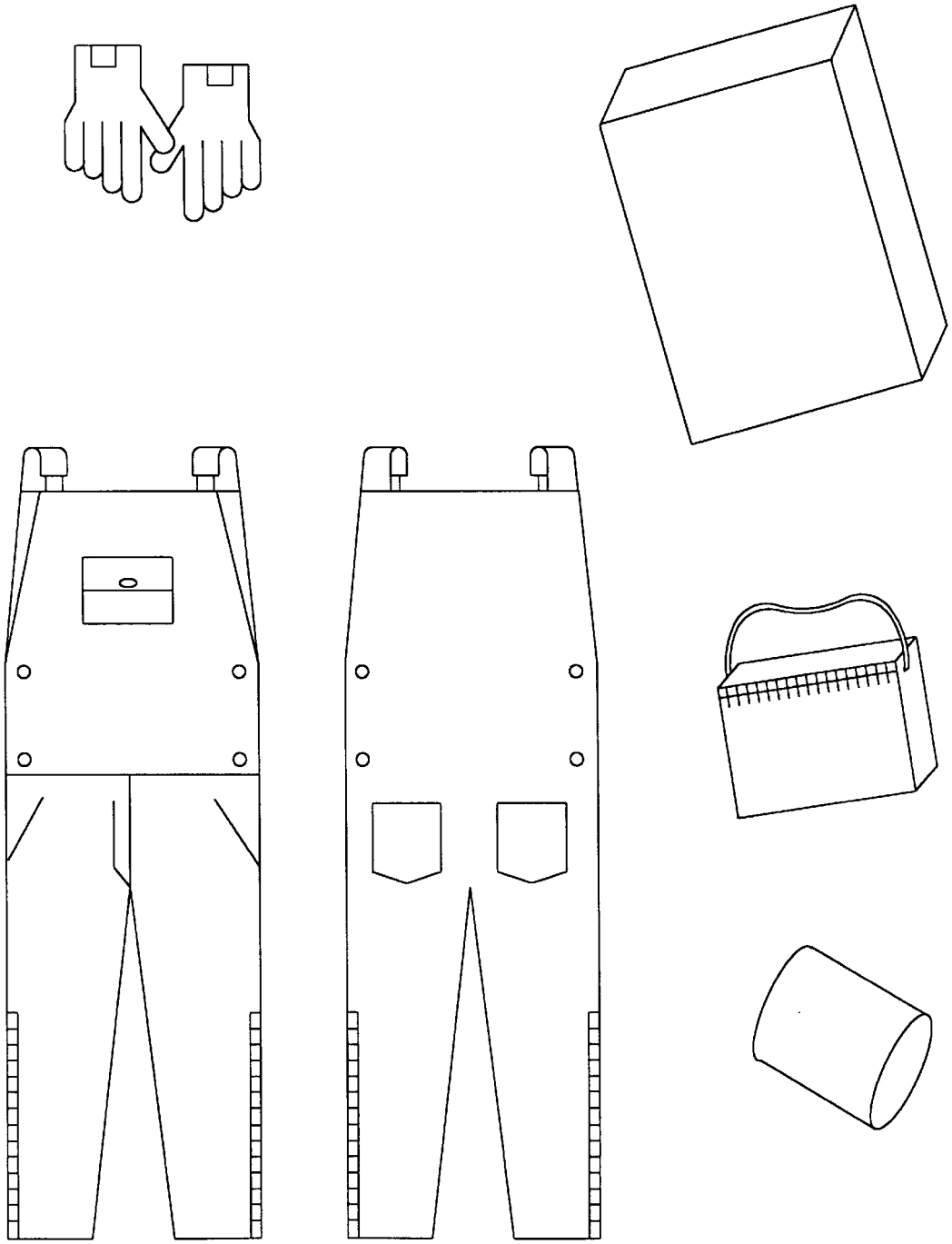
FIG. 9 shows the front and rear view of the overalls, gloves, backpack liner, hot/cold storage container, and pillow.

Referring specifically to the drawings in FIG. 1, numbers 13 and 17 are the zippers used to attach the backpack to the coat. After removing the backpack and emptying the contents, turn the flap (FIG. 4 number 18) inside the pack. Step into the bag. Then, start the zipper (number 17) from the left side of the coat and attach to the outside zipper track of the bag portion (number 13). Zip around to the right until the zipper locks in front of the coat to the right side. Adjust straps (number 16). Close coat using front zipper (number 8). Unsnap hood storage (numbers 9 and 2) to remove hood. Place on head and tighten with drawstring. To revert back to the backpack, remove hood from head and unzip the coat. Detach the bag section by reverse zipping. Step out of the bag section. Turn flap (FIG. 4 number 18) to outside of bag section. Place contents in backpack. Seal with flap. Adjust the straps (number 16). Use backpack straps (FIG. 4 number 23) to insert arms for carrying on the back. The backpack/sleeping bag section of the coatbag is simply a hollow, elongated sack composed of the same material with insulation as the coat section. If packed with symmetrical quadrilateral boxes, the backpack will conform its shape to the basic quadrilateral configuration as shown in FIGS. 5 and 6. When packed with asymmetrical and/or various different shaped items, the backpack has a collapsible and/or bulging configuration reflective of the irregularly shaped items inside.

What is claimed as our invention is:

1. A convertible coat and bag combination garment comprising: a coat upper portion constructed of an insulated material; said coat having an upper neckline edge having a collar and a detachable hood attached to the neckline edge under said collar which is stored under collar when not worn, said hood having an edge which encompases said wearer's face and said hood edge; said coat having a lower ee with a drawstring attached within the lower edge; said coat having a component of slide fastener attached along the lower edge to attach said coat upper portion to a lower sleeping bag portion; said lower sleeping bag portion is a hollow elongated sack constructed of the same insulated material as the coat and having an upper circumferential edge with a complementary zipper component attaching said bag edge to said coat edge to form an elongated coat bag structure; said lower sleeping bag portion having horizontal adjustable straps on a front of said bag portion and vertical adjustable straps attached on a back of said lower sleeping bag portion; said lower sleeping bag portion and said coat portion, when connected together, being sized to house the body of a wearer; said lower bag portion upper edge of said bag portion also including pull apart fasteners to seal said bag portion upper edge so that said coat and any desired items are stored therein; said coat portion and said bag portion having interior and exterior pockets attached therein and; said bag portion having a removable bag length liner secured with in said bag portion by at least one fastenable flaps.

* * * * *